United States Patent [19]

Rilovich

[11] Patent Number: 4,947,499

[45] Date of Patent: Aug. 14, 1990

[54] PORTABLE BACK REST

[76] Inventor: Janet M. Rilovich, 8373 El Paseo Grande, La Jolla, Calif. 92037

[21] Appl. No.: 440,907

[22] Filed: Nov. 24, 1989

[51] Int. Cl.[5] ..... A47C 20/00

[52] U.S. Cl. ..... 5/432; 5/419

[58] Field of Search ..... 5/419, 431, 432, 433, 5/440; 135/16

[56] References Cited

U.S. PATENT DOCUMENTS

| | | | |
|---|---|---|---|
| 839,501 | 12/1906 | Munro | 5/432 X |
| 1,363,697 | 12/1920 | Viera . | |
| 1,480,930 | 1/1924 | Bullard | 5/432 |
| 1,584,448 | 5/1926 | Garnham . | |
| 2,233,806 | 3/1941 | Bucknell . | |
| 4,363,517 | 12/1982 | Scott | 5/433 X |
| 4,711,260 | 12/1987 | Wiens et al. | 135/16 |

FOREIGN PATENT DOCUMENTS

| | | |
|---|---|---|
| 240754 | 10/1925 | United Kingdom . |
| 368694 | 9/1930 | United Kingdom . |

*Primary Examiner*—Michael F. Trettel

*Attorney, Agent, or Firm*—Brown, Martin, Haller & McClain

[57] ABSTRACT

A portable back rest which can be used for support of a person's back at the beach or similar location, yet can be collapsed into a small compact unit for carrying or storage, and includes a single, elongated base member to which four arms are pivotally connected enabling them to extend outwardly to support at their extremities canvas or other flexible material, but can be pivoted inwardly to a collapsed disposition adjacent the base member for portability and storage.

4 Claims, 1 Drawing Sheet

PORTABLE BACK REST

FIELD OF THE INVENTION

The present invention relates generally to back rests for humans and, more particularly, to a portable and collapsible back rest that can be utilized to provide back support for a person at the beach or other similar location.

BACKGROUND OF THE INVENTION

For use at the beach, in campgrounds or other locations, portable furniture in various forms has been designed and, in particular, certain collapsible elements have been designed for use at the beach or in other outdoor locations which can be collapsed to a limited degree to facilitate storage in a car, trunk or other location. However, most of these portable units, even in their collapsed disposition, have required considerable space for storage, and in most instances require the weight of the person to enable the requisite support for the back.

SUMMARY OF THE PRESENT INVENTION

It is the general objective of the present invention to provide a portable back rest which can be used to support a person's back while sitting on sand or in any other location, the unit being self-supporting and capable of folding to a collapsed disposition to occupy a minimum space to facilitate both portability and storage.

To achieve such an objective, the back rest preferably includes a thin, elongated base member to which a collar is slidably attached. A plurality of arms are pivotally attached to the collar so as to be capable of movement between parallel dispositions adjacent the elongated base member and outwardly angled dispositions so that the extremities of the arms are in laterally-spaced relation to enable support of a piece of canvas or other flexible material, which ultimately provides for support of the back of the user when two of the arms and the end of the base member are placed on the ground or other supporting surface.

DETAILED DESCRIPTION OF THE PREFERRRED EMBODIMENT OF THE INVENTION

Figure 1:
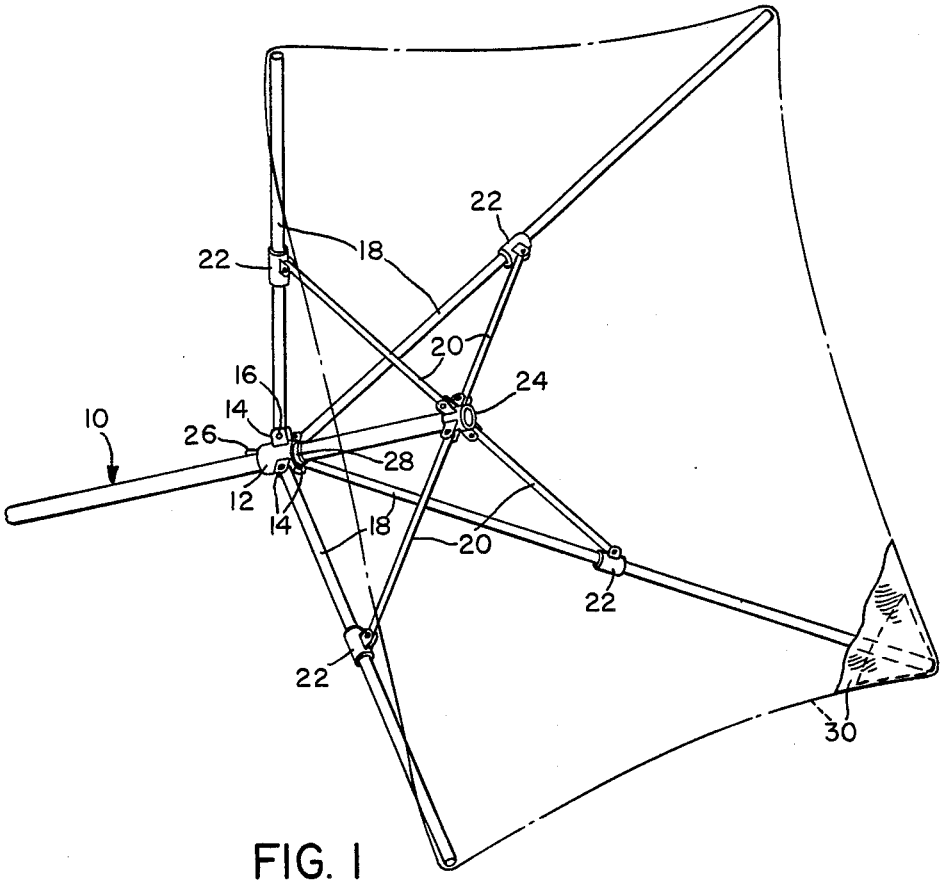
FIG. 1 is a perspective view of the preferred embodiment in open position.

With reference to the drawings, the preferred embodiment of the invention includes a thin, elongated, rigid base member 10 which may constitute a round bar composed of metal, plastic or other material, having a diameter of no more than one-half inch and a length of approximately two feet.

A collar 12 is loosely mounted on the base member for sliding movement therealong and includes four pairs of ears 14 supporting corresponding pivot pins 16 that pivotally mount each of four similar arms 18 to the collar at substantially 90 degree angular intervals. If the collar 12 lies in the position shown in FIG. 1 and in phantom lines in FIG. 2, the arms extend upwardly in angled dispositions, which constitute the operative dispositions of the unit, but if the collar is moved along the base member to the left, as viewed in FIGS. 1 and 2 to its collapsed disposition, the arms 18 come into substantially parallel disposition with the base member 10 and substantially within the overall length thereof, thus providing a collapsed unit of minimal dimensions, no more than two feet in length and approximately three inches in lateral extent. The arms 18 are supported in their outwardly extended operative dispositions by braces 20, each of which is joined to one of the arms by a pivotal connection 22 at an intermediate position, and is joined to the base member by a common pivotal connection 24 adjacent one end thereof so that when the arms are in their operative extended dispositions, the braces 20 extend substantially perpendicularly outward from the base member 10 so as to hold arms 18 in their operative dispositions, but at the same time permit the arms to move into the parallel collapsed dispositions upon movement of the collar 12 along the base member 10 in the manner described hereinbefore, the collapsed disposition of the braces, as well as the arms, being illustrated in full lines in FIG. 2.

Figure 2:
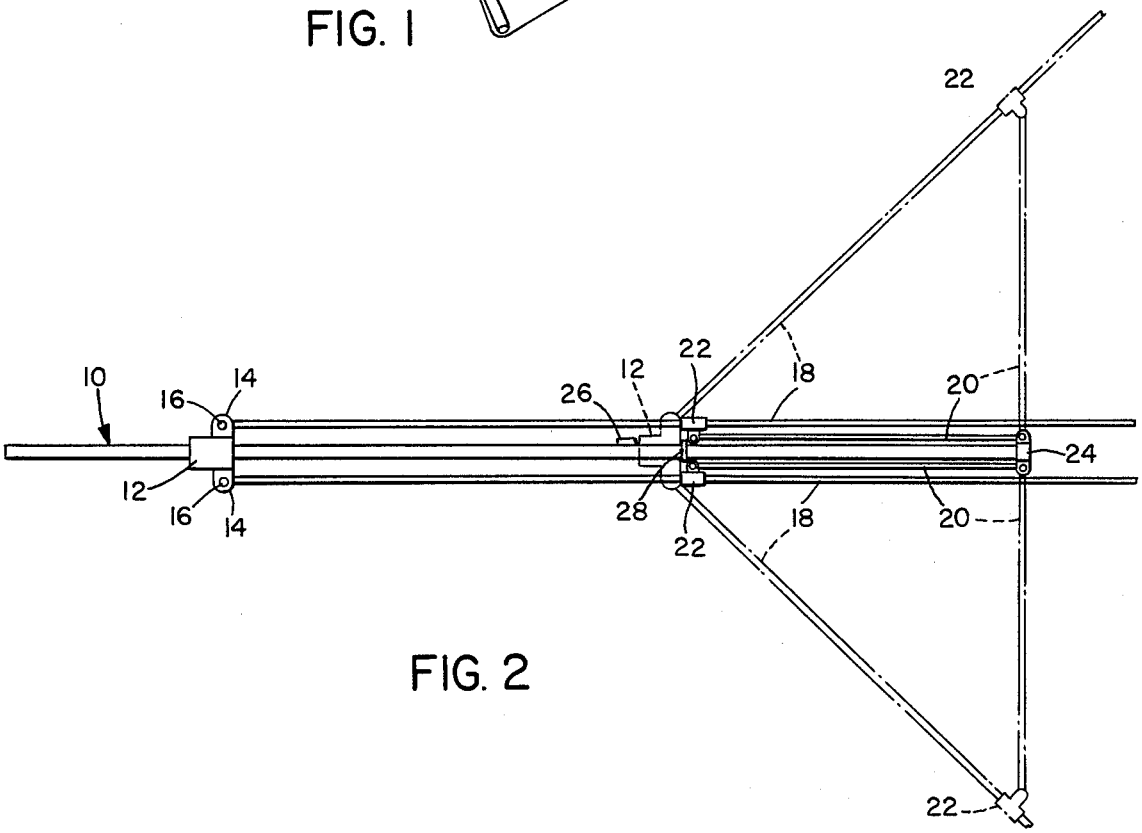
FIG. 2 is a side elevational view showing the invention in collapsed disposition, with phantom lines representing the open position.

To releasably hold the unit in its extended disposition, a spring latch 26 is mounted in one side of the base member 10 immediately behind the collar 12 when the arms are in their outwardly extended dispositions so as to releasably retain the arms in such operative dispositions, but to allow, upon slight finger pressure on the latch, the collar to be moved thereover to the inoperative collapsed disposition shown in FIG. 2 in full lines.

Preferably, to avoid over-extension of the arms; a rigid stop 28 is mounted on the base member 10 on the other side of the collar 12 when it is in its operative extended disposition.

A piece of canvas 30 or other flexible material having corner pockets, is releasably supported on the ends of the four arms 18 to engage and support a person's back when in the operative position shown in FIG. 1, but will accommodate the collapsed disposition shown in FIG. 2.

When the unit is moved to its operative extended disposition, it can be placed in a lateral position on the sand, ground or other similar surface, substantially as shown in FIG. 1, with two of the arm extremities and the opposite extremity of the base member resting in somewhat of a tripod configuration so that the entire structure is self-supporting. The user can then sit with his back against the canvas or other flexible member in a very comfortable position. The extremity of the angularly-disposed base member will dig into the sand or the earth to preclude a rearward motion of the unit when the user places his back against the canvas support.

It will be apparent that many modifications and/or alterations in this structure as described can be made without it departing from the spirit and scope of the present invention, and accordingly, the foregoing description of one embodiment is to be considered as purely exemplary and not in a limiting sense, and the actual scope of the invention is to be indicated only by reference to the appended claims.

I claim:

1. A portable back rest which comprises:

a thin, elongated base member;

a collar slidable along said base member;

a plurality of arms pivotally connected to said collar for movement between collapsed dispositions in substantial parallelism to said base member and outwardly angled operative dispositions;

a plurality of braces pivotally connected between said base member and said arms at an intermediate position for movement between collapsed dispositions in substantial parallelism to said base member and outwardly-disposed operative arm bracing dispositions;

a latch on said base member releasably holding said collar in its operative disposition whereat said arms are in their outwardly-angled dispositions; and flexible material supported only at the ends of said arms.

2. A portable back rest according to claim 1 wherein said arms are four in number and spaced at substantially 90 degree angles on said collar.

3. A portable back rest according to claim 1 wherein said braces are pivotally connected to said arms at positions spaced from the extremities thereof.

4. A portable back rest according to claim 1 which comprises a stop on said base member spaced from said latch for restricting movement of said collar therebeyond.

* * * * *